US011427880B2

(12) United States Patent
Yoshitomi et al.

(10) Patent No.: US 11,427,880 B2
(45) **Date of Patent: *Aug. 30, 2022**

(54) HIGH-STRENGTH GALVANIZED STEEL SHEET AND METHOD FOR MANUFACTURING SAME

(71) Applicant: JFE Steel Corporation, Tokyo (JP)

(72) Inventors: Hiromi Yoshitomi, Tokyo (JP); Yasuaki Okita, Tokyo (JP); Masaki Koba, Tokyo (JP); Hiroshi Matsuda, Tokyo (JP); Yoshihiko Ono, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 160 days.

This patent is subject to a terminal disclaimer.

(21) Appl. No.: 16/765,708

(22) PCT Filed: Aug. 20, 2018

(86) PCT No.: PCT/JP2018/030692
§ 371 (c)(1),
(2) Date: May 20, 2020

(87) PCT Pub. No.: WO2019/106894
PCT Pub. Date: Jun. 6, 2019

(65) Prior Publication Data

US 2020/0291499 A1 Sep. 17, 2020

(30) Foreign Application Priority Data

Nov. 29, 2017 (JP) ..... JP2017-228554

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/60*** | (2006.01) |
| ***C23C 2/06*** | (2006.01) |
| ***C23G 1/00*** | (2006.01) |

(52) U.S. Cl.

CPC ..... *C21D 9/46* (2013.01); *C21D 8/0236* (2013.01); *C21D 8/0273* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/60* (2013.01); *C23C 2/06* (2013.01); *C23G 1/00* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 8,133,330 | B2 | 3/2012 | Futamura et al. | |
| 9,611,524 | B2 | 4/2017 | Hamada et al. | |
| 2014/0234653 | A1 | 8/2014 | Nozaki et al. | |
| 2017/0218475 | A1 | 8/2017 | Kawasaki et al. | |
| 2019/0032187 | A1* | 1/2019 | Yoshitomi | C22C 38/26 |
| 2020/0291499 | A1 | 9/2020 | Yoshitomi et al. | |
| 2020/0377978 | A1* | 12/2020 | Yoshitomi | C22C 38/06 |
| 2021/0115529 | A1* | 4/2021 | Yoshitomi | C23C 2/06 |

FOREIGN PATENT DOCUMENTS

| | | | |
|---|---|---|---|
| CN | 107208205 | A | 9/2017 |
| EP | 3243923 | | 11/2017 |
| JP | 2007231373 | A | 9/2007 |

(Continued)

OTHER PUBLICATIONS

Extended European Search Report for European Application No. 18 883 091.3. dated Nov. 3, 2020, 10 pages.

Chinese Office Action for Chinese Application No. 201880076277.9, dated Dec. 3, 2021, with Concise Statement of Relevance of Office Action, 7 pages.

Chinese Office Action with Search Report for Chinese Application No. 201880076277.9, dated May 8, 2021, 12 pages.

Chinese Office Action for Chinese Application No. 201880076277.9, dated Sep. 29, 2021, with Concise Statement of Relevance of Office Action, 11 pages.

Korean Office Action for Korean Application No. 10-2020-7015196, dated Sep. 24, 2021, with Concise Statement of Relevance of Office Action, 7 pages .

(Continued)

*Primary Examiner* — Jophy S. Koshy

(74) *Attorney, Agent, or Firm* — RatnerPrestia

(57) ABSTRACT

A high-strength galvanized steel sheet is excellent in the external appearance of plating and the hydrogen brittleness resistance, and has a high yield ratio, and a method for manufacturing the same. The high-strength galvanized steel sheet including a steel sheet having a specific component composition and a specific steel structure, the amount of diffusible hydrogen in the steel sheet being 0.20 mass ppm or less; and a galvanizing layer provided on a surface of the steel sheet, the galvanizing layer having a content amount of Fe of 8 to 15% in mass %, and an attachment amount of plating per one surface of 20 to 120 g/m$^2$, wherein the amount of Mn oxides contained in the galvanizing layer is 0.050 g/m$^2$ or less; and the high-strength galvanized steel sheet has a yield strength of 700 MPa or more and a yield strength ratio of 65% or more and less than 85%.

18 Claims, 1 Drawing Sheet

(56) References Cited

FOREIGN PATENT DOCUMENTS

| | | | |
|---|---|---|---|
| JP | 2011111671 | A | 6/2011 |
| JP | 2012041597 | A | 3/2012 |
| JP | 2013213232 | A | 10/2013 |
| JP | 5438302 | B2 | 3/2014 |
| JP | 2015151607 | A | 8/2015 |
| JP | 2017145441 | A | 8/2017 |
| KR | 20160072898 | A | 6/2016 |
| WO | 2013047836 | A1 | 4/2013 |
| WO | 2016111274 | A1 | 7/2016 |
| WO | 2017131055 | A1 | 8/2017 |
| WO | 2017131056 | A1 | 8/2017 |

OTHER PUBLICATIONS

International Search Report and Written Opinion for International Application No. PCT/JP2018/030692, dated Nov. 13, 2018, 6 pages.
Japanese Office Action for Japanese Application No. 2019-015200, dated Feb. 26, 2020, with Concise Statement of Relevance of Office Action, 6 pages.
Non Final Office Action for U.S. Appl. No. 16/766,398, dated Jan. 21, 2022, 9 pages.
Korean Office Action for Korean Application No. 10-2020-7015196, dated Mar. 29, 2022 with Concise Statement of Relevance of Office Action, 5 pages.
Non Final Office Action for U.S. Appl. No. 16/960,733, dated May 23, 2022, 27 pages.

* cited by examiner

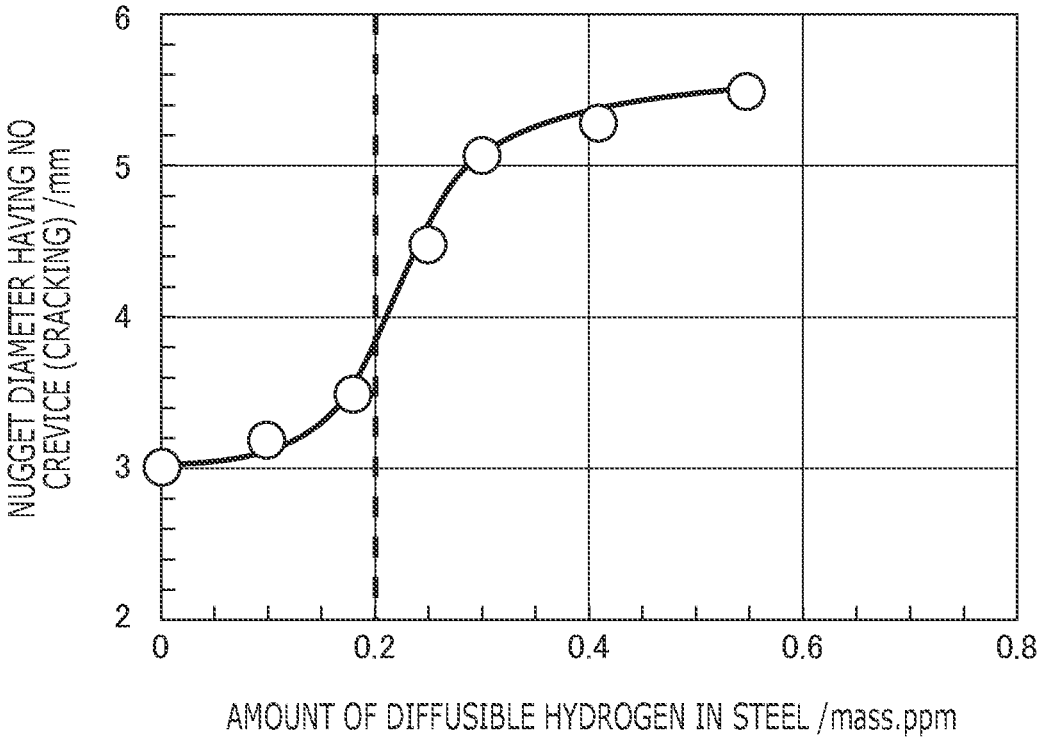
NUGGET DIAMETER HAVING NO CREVICE (CRACKING) /mm
6
5
4
3
2
0
0.2
0.4
0.6
0.8
AMOUNT OF DIFFUSIBLE HYDROGEN IN STEEL /mass.ppm

HIGH-STRENGTH GALVANIZED STEEL SHEET AND METHOD FOR MANUFACTURING SAME

CROSS REFERENCE TO REALTED APPLICATIONS

This is the U.S. National Phase application of PCT/JP2018/030692, filed Aug. 20, 2018, which claims priority to Japanese Patent Application No. 2017-228554, filed Nov. 29, 2017, the disclosures of each of these applications being incorporated herein by reference in their entireties for all purposes.

FIELD OF THE INVENTION

The present invention relates to a high-strength galvanized steel sheet that easily suppresses hydrogen embrittlement, which becomes more likely to occur as the strength of the steel becomes higher, and that is suitable for building materials and automotive collision-resistant parts, and a method for manufacturing the same.

BACKGROUND OF THE INVENTION

In these days, collision safety and fuel efficiency improvement of automobiles are strongly required. The strength of steel sheets that are materials of parts is increasing. Among them, materials used in and around the cabin are required to have a high yield ratio (YR; YR=(YS/TS)×100(%)) from the viewpoint of ensuring the safety of the occupant when the automobile collides. Further, in view of the fact that automobiles are being widely spread on a global scale and automobiles are used for various uses in diverse areas and climates, steel sheets that are materials of parts are required to have high antirust properties. However, in general, when plating of Zn, Ni, or the like is provided, hydrogen is less likely to be released from or incorporated into the material, and therefore in-steel hydrogen called diffusible hydrogen is likely to stay behind and the hydrogen embrittlement of the material is likely to occur.

Thus far, steel sheets having high yield ratios have been developed; however, compatibility between heat treatment conditions necessary to create a metal structure for obtaining a high yield ratio and plating ability, and the suppression of hydrogen embrittlement as a plating material, particularly nugget cracking occurring in a short time after welding, are great issues to solve. Since a weld is a portion in which a steel sheet is melted once and solidified again, the vicinity of the weld has residual stress acting thereon, and is in a situation of being more susceptible to hydrogen embrittlement.

Patent Literature 1 discloses a hot-dip galvanized steel sheet with a high yield ratio and high strength excellent in processability, and a method for manufacturing the same.

Patent Literature 2 discloses a method of providing a steel sheet that has a tensile strength of 980 MPa or more, exhibits a high yield ratio, and is excellent in processability (specifically, strength-ductility balance).

Patent Literature 3 discloses a high-strength hot-dip galvanized steel sheet that uses, as a matrix, a high-strength steel sheet containing Si and Mn and is excellent in the external appearance of plating, corrosion resistance, plating peeling resistance during high processing, and processability during high processing, and a method for manufacturing the same.

Patent Literature 4 discloses a method for manufacturing a high-strength plated steel sheet having good delayed fracture resistance characteristics. This literature employs a metal structure mainly composed of ferrite and martensite in order to improve delayed fracture resistance characteristics and further in order to increase strength while maintaining a low yield ratio, and discloses the creation of a martensite structure.

Patent Literature 5 discloses a plated steel sheet for hot pressing excellent in delayed fracture resistance characteristics, and a method for manufacturing the same. A precipitate in steel is utilized; before plating, the entry of diffusible hydrogen is suppressed as much as possible by means of manufacturing process conditions; and in-steel hydrogen after plating is caused to be trapped as non-diffusible hydrogen.

Patent Literature 6 discloses a high-strength steel sheet that is made of a steel sheet with a matrix strength (TS) of less than approximately 870 MPa and is excellent in weld hydrogen brittleness, and a method for manufacturing the same; and has improved hydrogen brittleness by dispersing oxides in the steel.

PATENT LITERATURE

Patent Literature 1: JP 5438302 B2
Patent Literature 2: JP 2013-213232 A
Patent Literature 3: JP 2015-151607 A
Patent Literature 4: JP 2011-111671 A
Patent Literature 5: JP 2012-41597 A
Patent Literature 6: JP 2007-231373 A

SUMMARY OF THE INVENTION

In the technology of Patent Literature 1, the metal structure is a composite structure containing ferrite and martensite; hence, although the metal structure has a high yield ratio, the yield ratio is increased only up to a YR of approximately 70%. Further, in Patent Literature 1, large amounts of Si and Mn are contained, and therefore plating quality tends to be poor; a method to solve this is not disclosed.

In the technology of Patent Literature 2, although the addition of Si, which reduces plating stickiness, is suppressed, cases where there is an addition amount of Mn of more than 2.0% encounter a situation where Mn-based oxides are likely to be generated on the surface of the steel sheet and plating ability is generally impaired; however, in this literature, conditions at the time of forming a plating layer are not particularly limited but conditions usually used are employed, and plating ability is poor.

In the technology of Patent Literature 3, in an annealing step before plating, the hydrogen concentration of an furnace atmosphere is limited to 20 vol % or more, and the annealing temperature to 600 to 700° C. This technology cannot be used for materials having Ac3 points more than 800° C. in terms of metal structure formation; further, if the hydrogen concentration in an annealing furnace atmosphere is high, the concentration of in-steel hydrogen is increased, and hydrogen brittleness resistance is poor.

In the technology of Patent Literature 4, although delayed fracture resistance characteristics after processing are improved, the hydrogen concentration during annealing is high, and hydrogen remains in the matrix itself and hydrogen brittleness resistance is poor.

In the technology of Patent Literature 5, if there is a large amount of several-micron-order precipitate, mechanical characteristics, particularly ductility and bendability, of the material itself are degraded, and bad influence is given during cold pressing; hence, this technique does not solve the issue.

In the technology of Patent Literature 6, a large amount of oxides gives fatal bad influence to bending molding, stretch flange molding, etc., which are greatly used when molding a high-strength steel sheet having a high TS such as those 1000 MPa or more. Further, when the upper limit of the hydrogen concentration in a furnace of a continuous plating line is 60%, annealing at a high temperature of the Ac3 point or more causes a large amount of hydrogen to be incorporated into the steel; hence, this method cannot manufacture a high-strength steel sheet that has a TS of 1100 MPa or more and is excellent in hydrogen brittleness resistance.

An object of the present invention is, for a high-strength plated steel sheet having concern with hydrogen embrittlement, to provide a high-strength galvanized steel sheet that has material quality that has achieved a high yield ratio of high demand, is excellent in the external appearance of plating and the hydrogen brittleness resistance of the material, and has a high yield ratio suitable for building materials and automotive collision-resistant parts, and a method for manufacturing the same.

The present inventors, in order to solve the issues described above, diligently conducted investigations of various thin steel sheets regarding the relationship between tensile strength (TS) and yield strength (YS), and regarding overcoming cracking of a weld nugget as plating ability and hydrogen brittleness resistance. As a result, the present inventor found the appropriate conditions for the temperature and atmosphere during heat treatment by creating the most suitable steel structure and controlling the amount of in-steel hydrogen by appropriately adjusting manufacturing conditions in addition to the component composition of the steel sheet. Specifically, the present invention according to exemplary embodiments provides the followings.

[1] A high-strength galvanized steel sheet including: a steel sheet having a steel composition having a component composition containing, in mass %, C: 0.10% or more and 0.30% or less, Si: less than 1.2%, Mn: 2.0% or more and 3.5% or less, P: 0.010% or less, S: 0.002% or less, Al: 1% or less, N: 0.006% or less, and the balance including Fe and unavoidable impurities, and a steel structure containing 50% or more of martensite, 30% or less of ferrite (including 0%), and 10 to 50% of bainite, and further containing less than 5% (including 0%) of residual austenite, in terms of area ratio, 30% or more of the martensite being tempered martensite (including self-tempered martensite), the amount of diffusible hydrogen in the steel being 0.20 mass ppm or less; and a galvanizing layer provided on a surface of the steel sheet, having a content amount of Fe of 8 to 15% in mass %, and an attachment amount of plating per one surface of 20 to 120 $g/m^2$, wherein the amount of Mn oxides contained in the galvanizing layer is 0.050 $g/m^2$ or less, and a yield strength is 700 MPa or more and a yield strength ratio is 65% or more and less than 85%.

[2] The high-strength galvanized steel sheet according to [1], wherein the component composition further contains any one or more selected from, in mass %, one or more of Ti, Nb, V, and Zr: 0.005 to 0.1% in total, one or more of Mo, Cr, Cu, and Ni: 0.005 to 0.5% in total, and B: 0.0003 to 0.005%.

[3] The high-strength galvanized steel sheet according to [1] or [2], wherein the component composition further contains, in mass %, any one or two selected from Sb: 0.001 to 0.1% and Sn: 0.001 to 0.1%. p [4] The high-strength galvanized steel sheet according to any one of [1] to [3], wherein the component composition further contains, in mass %, Ca: 0.0010% or less.

[5] A method for manufacturing a high-strength galvanized steel sheet including: an annealing step of heating a cold rolled material having the component composition according to any one of [1] to [4] in an in-annealing-furnace atmosphere with a hydrogen concentration H of 1 vol % or more and 13 vol % or less, at an annealing-furnace temperature T of (an Ac3 point −20° C.) to 900° C. or less for 5 sec or more, then performing cooling, and allowing the cold rolled material to stay in a temperature region of 400 to 550° C. for 10 sec or more; a plating step of subjecting a steel sheet after the annealing step to plating treatment and alloying treatment, and performing cooling up to 100° C. or less at an average cooling rate of 3° C./s or more; and a later heat treatment step of allowing a plated steel sheet after the plating step to stay in an in-furnace atmosphere with a hydrogen concentration H of 10 vol % or less and a dew point Dp of 50° C. or less, at a temperature T (° C.) of 200° C. or less for a time t (hr) or more that is 0.01 (hr) or more and satisfies a ($_1$) formula.

$$130-18.3\times ln(t)\leq T \quad (1)$$

[6] The method for manufacturing a high-strength galvanized steel sheet according to [5], including, before the annealing step: an earlier treatment step of heating the cold rolled material up to an Ac1 point to the Ac3 point+50° C. and performing pickling.

[7] The method for manufacturing a high-strength galvanized steel sheet according to [5] or [6], wherein, after the plating step, temper rolling is performed at an extension rate of 0.1% or more.

[8] The method for manufacturing a high-strength galvanized steel sheet according to [7], wherein width trimming is performed after the later heat treatment step.

[9] The method for manufacturing a high-strength galvanized steel sheet according to [7], wherein width trimming is performed before the later heat treatment step, and a staying time t (hr) for staying at a temperature T (° C.) of 200° C. or less in the later heat treatment step is 0.01 (hr) or more and satisfies a (2) formula.

$$115-18.3\times ln(t)\leq T \quad (2)$$

According to an embodiment of the present invention, a high-strength galvanized steel sheet that has high strength of a yield strength of 700 MPa or more, has a high yield ratio (yield strength ratio) of 65% or more and less than 85%, is excellent in plating ability and surface external appearance, and is excellent also in hydrogen brittleness resistance is obtained.

BRIEF DESCRIPTION OF DRAWINGS

The FIG. 1 is a diagram showing an example of relationship between the amount of diffusible hydrogen and the smallest nugget diameter.

DETAILED DESCRIPTION OF EMBODIMENTS OF THE INVENTION

Hereafter, the embodiments of the present invention will be described. Here, the present invention is not limited to the embodiments described below.

<High-Strength Galvanized Steel Sheet>

A high-strength galvanized steel sheet according to an embodiment of the present invention includes a steel sheet and a galvanizing layer formed on a surface of the steel sheet. In the following, the steel sheet and the galvanizing layer are explained in this order.

The component composition of the steel sheet is as follows. In the following description, "%" that is the unit of the content amount of a component means "mass %".

C: 0.10% or more and 0.30% or less (C: 0.10 to 0.30%)

C is an element effective to achieve high strength of the steel sheet, and contributes to strength increase by forming martensite, which is one of the hard phases of the steel structure. To obtain these effects, the content amount of C needs to be 0.10% or more. The content amount of C is preferably 0.11% or more, and more preferably 0.12% or more. On the other hand, if the content amount of C is more than 0.30%, in an embodiment of the present invention, spot weldability is significantly degraded, and at the same time the steel sheet is hardened due to the strength increase of martensite and moldability such as bendability tends to be reduced. Thus, the content amount of C is set to 0.30% or more. From the viewpoint of characteristics improvement, the content amount of C is set to preferably 0.28% or less, and more preferably 0.25% or less.

Si: less than 1.2%

Si is an element contributing mainly to strength increase by solid solution strengthening; and experiences relatively small reduction in ductility with respect to strength rising, and contributes to not only strength but also improvement in balance between strength and ductility. On the other hand, Si is likely to form Si-based oxides on the surface of the steel sheet and may be a cause of non-plating, and furthermore stabilizes austenite during annealing and makes it likely to cause residual austenite to be formed in the final product. Thus, it is sufficient to add only an amount necessary to ensure strength; from this point of view, the content amount of Si is desirably 0.01% or more. The content amount of Si is more preferably 0.02% or more. The content amount of Si is still more preferably 0.05% or more. From the viewpoints of plating ability and the production of residual austenite, the upper limit is set to less than 1.2%. The upper limit is preferably 1.0% or less. The upper limit is more preferably 0.9% or less.

Mn: 2.0% or more and 3.5% or less

Mn is effective as an element contributing to strength increase by solid solution strengthening and martensite formation. To obtain this effect, the content amount of Mn needs to be set to 2.0% or more. The content amount of Mn is preferably 2.1% or more, and more preferably 2.2% or more. On the other hand, if the content amount of Mn is more than 3.5%, spot weld cracking is brought about, and unevenness is likely to occur in the steel structure due to segregation or the like of Mn and a reduction in processability is brought about. Further, if the content amount of Mn is more than 3.5%, Mn is likely to concentrate as oxides or composite oxides on the surface of the steel sheet, and may be a cause of non-plating. Thus, the content amount of Mn is set to 3.5% or less. The content amount of Mn is preferably 3.3% or less, and more preferably 3.0% or less.

P: 0.010% or less

P is an effective element contributing to the strength increase of the steel sheet by solid solution strengthening. If the content amount of P is more than 0.010%, processability such as weldability and stretch flanging ability is reduced. Thus, the content amount of P is set to 0.010% or less. The content amount of P is preferably 0.008% or less, and more preferably 0.007% or less. The lower limit is not particularly prescribed; however, if the lower limit is less than 0.001%, a reduction in production efficiency and an increase in dephosphorization cost are brought about in the manufacturing course; thus, the lower limit is preferably set to 0.001% or more.

S: 0.002% or less

S is a harmful element that is a cause of hot brittleness, brings about a reduction in weldability, and reduces the processability of the steel sheet by existing as sulfide-based inclusions in the steel. Hence, the content amount of S is preferably reduced as much as possible. Thus, the content amount of S is set to 0.002% or less. The lower limit is not particularly prescribed; however, if the lower limit is less than 0.0001%, a reduction in production efficiency and cost increase are brought about in the existing manufacturing course; thus, the lower limit is preferably set to 0.0001% or more.

Al: 1% or less

Al is added as a deoxidizing material. From the viewpoint of obtaining this effect, a preferred content amount is 0.01% or more. The content amount of Si is more preferably 0.02% or more. On the other hand, content amounts of Al of more than 1% bring about a rise in source material cost, and are a cause of inducing surface defects of the steel sheet; thus, this value is taken as the upper limit. The upper limit is preferably 0.4% or less, and more preferably 0.1% or less.

N: 0.006% or less

If the content amount of N is more than 0.006%, surplus nitrides are produced in the steel and ductility and toughness are reduced, and the worsening of the surface condition of the steel sheet may be brought about. Hence, the content amount of N is set to 0.006% or less, preferably 0.005% or less, and more preferably 0.004% or less. Although the content amount is preferably as small as possible from the viewpoint of improving ductility by making ferrite cleaner, such amounts bring about a reduction in production efficiency and cost increase in the manufacturing course; thus, a preferred lower limit is set to 0.0001% or more. The lower limit is more preferably 0.0010% or more, and still more preferably 0.0015% or more.

The component composition of the steel sheet mentioned above may contain, as an optional component, one or more of Ti, Nb, V, and Zr at 0.005 to 0.1% in total, one or more of Mo, Cr, Cu, and Ni at 0.005 to 0.5% in total, and/or B: 0.0003 to 0.005%.

Ti, Nb, V, and Zr contribute to the strength increase of the steel sheet by being formed as a fine precipitate that forms, together with C or N, a carbide or a nitride (there is also a case of a carbonitride). From the viewpoint of obtaining this effect, it is preferable to contain one or more of Ti, Nb, V, and Zr at 0.005% or more in total. The total content amount is more preferably 0.015% or more, and still more preferably 0.030% or more. These elements are effective also for trap sites (rendering harmless) of in-steel hydrogen. However, surplus content amounts of more than 0.1% in total increase deformation resistance during cold rolling and inhibit productivity; in addition, the presence of a surplus or coarse precipitate reduces the ductility of ferrite, and reduces processability such as ductility, bendability, and stretch flanging ability of the steel sheet. Thus, the total amount mentioned above is preferably set to 0.1% or less. The total amount is more preferably 0.08% or less, and still more preferably 0.06% or less.

Mo, Cr, Cu, Ni, and B enhance hardenability and facilitate the production of martensite, and are therefore elements contributing to strength increase. Thus, the amount of one or more of Mo, Cr, Cu, and Ni is preferably set to 0.005% or more in total. The amount is more preferably 0.01% or more, and still more preferably 0.05% or more. In the case of B, the amount of B is preferably 0.0003% or more, more preferably 0.0005% or more and still more preferably 0.0010% or more. For Mo, Cr, Cu, and Ni, surplus addition amounts of more than 0.5% in total lead to the saturation of the effect and cost increase. For Cu, it induces cracking during hot rolling, and is a cause of the occurrence of surface flaws; thus, the upper limit of the amount of Cu is set to 0.5%. For Ni, there is an effect of hindering the occurrence of surface flaws due to containing Cu, and it is therefore desirable that Ni be contained when Cu is contained. In particular, it is preferable to contain an amount of Ni ½ or more of the content amount of Cu. Also for B, the lower limit mentioned above for obtaining the effect of suppressing ferrite production occurring during an annealing cooling course is provided. Further, an upper limit is provided because surplus content amounts of B of more than 0.005% lead to the saturation of the effect. Surplus hardenability has also a disadvantage such as weld cracking during welding.

The component composition of the steel sheet mentioned above may contain, as an optional component, Sb: 0.001 to 0.1% and/or Sn: 0.001 to 0.1%.

Sb and Sn suppress decarburization, denitrification, deboronization, etc., and are elements effective to suppress the reduction in the strength of the steel sheet. These elements are effective also to suppress spot welding cracking; thus, each of the content amount of Sn and the content amount of Sb is preferably 0.001% or more. Each content amount is more preferably 0.003% or more, and still more preferably 0.005% or more. However, for both Sn and Sb, surplus content amounts of more than 0.1% reduce processability such as stretch flanging ability of the steel sheet. Thus, each of the content amount of Sn and the content amount of Sb is preferably set 0.1% or less. Each content amount is more preferably 0.030% or less, and still more preferably 0.010% or less.

The component composition of the steel sheet mentioned above may contain, as an optional component, Ca: 0.0010% or less.

Ca forms a sulfide or an oxide in the steel, and reduces the processability of the steel sheet. Hence, the content amount of Ca is preferably 0.0010% or less. The content amount of Ca is more preferably 0.0005% or less, and still more preferably 0.0003% or less. The lower limit is not particularly limited; however, in terms of manufacturing, it may be difficult to contain no Ca; thus, in view of this, the content amount of Ca is preferably 0.00001% or more. The content amount of Ca is more preferably 0.00005% or more.

In the component composition of the steel sheet mentioned above, the balance other than the above is Fe and unavoidable impurities. For the optional components mentioned above, in the case where a component having a lower limit of its content amount is contained at a ratio less than the lower limit value mentioned above, the effect of the present invention is not impaired, and hence the optional component is regarded as an unavoidable impurity.

Next, the metal structure (steel structure) of the steel sheet is described. The metal structure of the steel sheet contains 50% or more of martensite, 30% or less (including 0%) of ferrite, and 10 to 50% of bainite, and further contains less than 5% (including 0%) of residual austenite, in terms of area ratio; 30% or mode of the martensite is tempered martensite (including self-tempered martensite).

Setting the area ratio of martensite to 50% or more is necessary in order to ensure strength. The upper limit of the area ratio of martensite is preferably 85% or less, and more preferably 80% or less.

In the martensite mentioned above, tempered martensite is contained at 30% or more. Yield strength can be ensured in the case that the proportion of tempered martensite is 30% or more. The proportion of tempered martensite may be 100%. The tempered martensite includes self-tempered martensite.

The steel structure mentioned above contains 30% or less of ferrite in terms of area ratio. Setting the area ratio of ferrite 30% or less is necessary in order to ensure strength. The lower limit is not particularly limited, but the area ratio of ferrite is often 2% or more, or 4% or more. The steel structure mentioned above may not contain ferrite (that is, the area ratio of ferrite may be 0%).

The steel structure mentioned above contains 10% or more of bainite in terms of area ratio. Yield strength can be ensured by containing 10% or more of bainite. The area ratio is preferably 15% or more, and more preferably 20% or more. If the proportion of bainite is too large, yield strength is reduced likewise. Hence, in order to ensure yield strength, the area ratio of bainite is set to 50% or less. The area ratio of bainite is preferably 49% or less, more preferably 45% or less, and still more preferably 40% or less. In particular, transforming austenite to bainite and ferrite before plating is important from the viewpoint of reducing the amount of in-steel hydrogen.

The proportion of residual austenite is set to less than 5% from the viewpoint of reducing the amount of diffusible hydrogen in the steel. Although residual austenite may account for 0%, there are not a few cases where residual austenite is contained at 1% or more. The measurement result of residual austenite is obtained by the volume ratio; the volume ratio is regarded as the area ratio.

The metal structure occasionally contains a precipitate of pearlite, carbides, etc. in the balance, as a structure other than the structure (phase) mentioned above. These can be permitted as long as they account for less than 10% as the total area ratio at a position of ¼ of the sheet thickness from the surface.

The method for measuring the area ratio is described in Examples; that is, the area ratio mentioned above is found by a method in which a structure in a region of a position of ¼ of the sheet thickness from the surface is taken as a representative, an L-cross section (a sheet-thickness cross section parallel to the rolling direction) of the steel sheet is polished, then corrosion is performed with a nital solution, 3 or more fields of view are observed by SEM with a magnification of 1500 times, and the photographed images are analyzed.

In the steel sheet mentioned above, the amount of diffusible hydrogen in the steel obtained by measurement by a method described in Examples is 0.20 or less mass ppm. Diffusible hydrogen in the steel degrades hydrogen brittleness resistance. If the amount of diffusible hydrogen in the steel is a surplus more than 0.20 mass ppm, crevice cracking of a weld nugget is likely to occur during welding, for example. In an embodiment of the present invention, it has been revealed that an improvement effect is obtained by, before welding, making the amount of diffusible hydrogen in the steel, i.e., the matrix, 0.20 or less mass ppm. The amount of diffusible hydrogen is preferably 0.15 mass ppm or less, more preferably 0.10 or less mass ppm, and still more preferably 0.08 or less mass ppm. The lower limit is not particularly limited, but is preferably as small as possible; thus, the lower limit is 0 mass ppm. It is necessary that, before welding, the amount of diffusible hydrogen mentioned above be made 0.20 or less mass ppm; when the amount of diffusible hydrogen of the matrix portion is 0.20 or less mass ppm in a product after welding, the amount of diffusible hydrogen can be regarded as having been 0.20 or less mass ppm before welding.

Next, the galvanizing layer is described.

For the galvanizing layer, the attachment amount of plating per one surface is 20 to 120 g/m$^2$. If the attachment amount is less than 20 g/m$^2$, it is difficult to ensure corrosion resistance. On the other hand, if the attachment amount is more than 120 g/m$^2$, plating peeling resistance is degraded.

In the galvanizing layer, Mn oxides formed by a heat treatment step before plating are incorporated into the plating by the plating bath and the steel sheet reacting together to form an FeAl or FeZn alloy phase, and plating ability and plating peeling resistance are improved.

The amount of Mn oxides contained in the galvanizing layer is preferably as low as possible; however, suppressing the amount of Mn oxides to less than 0.005 g/m$^2$ is difficult because it is necessary to control the dew point to lower than a normal operating condition. Further, if the amount of Mn oxides in the plating layer is more than 0.050 g/m$^2$, the formation reaction of an FeAl or FeZn alloy phase will be insufficient, and the occurrence of non-plating and a reduction in plating peeling resistance are brought about. Thus, the amount of Mn oxides in the plating layer is set to 0.050 or less g/m$^2$. As above, the amount of Mn oxides in the plating layer is preferably 0.005 or more g/m$^2$ and 0.050 or less g/m$^2$. The measurement of the amount of Mn oxides in the galvanizing layer is performed by a method described in Examples.

The galvanizing layer contains Fe at 8 to 15% in mass %. When the content amount of Fe in the galvanizing layer is 8% or more in mass %, it can be said that an alloy layer of Fe—Zn is sufficiently obtained. The content amount of Fe is preferably 9% or more, and more preferably 10% or more. If the content amount of Fe is more than 15%, plating stickiness is worsened, and a trouble called powdering is caused during pressing. Thus, the content amount of Fe mentioned above is set to 15% or less. The content amount of Fe is preferably 14% or less, and more preferably 13% or less.

As mentioned above, the galvanizing layer may contain one or two or more selected from Pb, Sb, Si, Sn, Mg, Mn, Ni, Cr, Co, Ca, Cu, Li, Ti, Be, Bi, and the REMs at 0 to 30% in total. The balance is Zn and unavoidable impurities.

<Method for Manufacturing High-Strength Galvanized Steel Sheet>

A method for manufacturing the high-strength galvanized steel sheet according to an embodiment of the present invention includes an annealing step, a plating step, and a later heat treatment step.

The annealing step is a step for heating a cold rolled material having the component composition described above in an in-annealing-furnace atmosphere with a hydrogen concentration H of 1 or more vol % and 13 or less vol %, at an in-annealing-furnace temperature T of (an $A_{c3}$ point −20° C.) to 900° C. or less for 5 or more sec, then performing cooling, and allowing the cold rolled material to stay in a temperature region of 400 to 550° C. for 10 or more sec.

First, a method for manufacturing a cold rolled material is described below.

A cold rolled material used in the manufacturing method according to an embodiment of the present invention is manufactured from steel. Steel is generally called as a slab (cast piece) which is manufactured by using a continuous casting method. A continuous casting method is used in order to prevent the macro segregation of alloy constituent chemical elements. Steel may be manufactured by using, for example, an ingot-making method or a thin-slab casting method.

In addition, after a steel slab has been manufactured, hot rolling may be performed by using any one of a conventional method in which the slab is reheated after having been cooled to room temperature, a method in which hot rolling is performed after the slab has been charged into a heating furnace in the warm state without having been cooled to near-room temperature, a method in which hot rolling is performed immediately after the slab has been subjected to heat retention for a short time, and a method in which hot rolling is performed directly on a cast piece in the hot state.

Although there is no particular limitation on the conditions used for hot rolling, it is preferable that steel having the component composition described above be heated to a temperature of 1100° C. or higher and 1350° C. or lower, subjected to hot rolling with a finishing rolling temperature of 800° C. or higher and 950° C. or lower, and coiled at a temperature of 450° C. or higher and 700° C. or lower. In the description below, those preferable conditions is explained.

It is preferable that the steel slab heating temperature be 1100° C. or higher and 1350° C. or lower. The grain diameter of precipitates in the steel slab tends to increase in the case where the slab-heating temperature is higher than the upper limit described above, and there may be a disadvantage in that it is difficult, for example, to achieve satisfactory strength through precipitation strengthening. In addition, there may be a case where precipitates having a large grain diameter have negative effects on the formation of a microstructure in the subsequent heat treatment. On the other hand, achieving a smooth steel sheet surface by appropriately performing heating in order to remove, for example, blowholes and defects from the surface of the slab through scale off so that there is a decrease in the number of cracks and in the degree of asperity on the surface of a steel sheet is advantageous. It is preferable that the heating temperature be 1100° C. or higher in order to realize such an effect. On the other hand, in the case where the heating temperature is higher than 1350° C., since there is an increase in austenite grain diameter, there is an increase in the grain diameter of the metal structure of a final product, which may result in a deterioration in the strength and processability such as bendability and stretch flanging ability of a steel sheet.

The heated steel slab is subjected to hot rolling including rough rolling and finish rolling. Generally, a steel slab is made into a sheet bar by performing rough rolling, and the sheet bar is made into a hot-rolled coil by performing finish rolling. In addition, there is no problem in the case where rolling is performed regardless of such a classification depending on, for example, rolling mill capacity as long as a specified size is obtained. It is preferable that hot rolling be performed under the conditions described below.

Finishing rolling temperature: 800° C. or higher and 950° C. or lower is preferable. By controlling the finishing rolling temperature to be 800° C. or higher, there is a tendency for the microstructure of a hot-rolled coil to be homogeneous. Controlling the microstructure at this stage to be homogeneous contributes to homogenizing the microstructure of a final product. In the case where a microstructure is inhomogeneous, there is deterioration in ductility and processability such as bendability and stretch flanging ability. On the other hand, in the case where the finishing rolling temperature is higher than 950° C., since there is an increase in the amount of oxides (scale) formed, there is an increase in the degree of asperity of an interface between the base steel and the oxides, which may result in a deterioration in the surface quality after pickling or cold rolling has been performed.

In addition, there is an increase in the crystal grain diameter of a microstructure, which may result in deterioration in the strength and processability such as bendability and stretch flanging ability of a steel sheet as in the case of a steel slab. After hot rolling has been performed as described above, for the purpose of the refinement and homogenization of a microstructure, it is preferable that cooling be started within 3 seconds after finish rolling has been performed and that cooling be performed at an average cooling rate of 10° C./s to 250° C./s in a temperature region from [finishing rolling temperature]° C. to [finishing rolling temperature-100]° C.

The winding temperature is preferably set to 450 to 700° C. The temperature immediately before coil winding after hot rolling, that is, the winding temperature 450° C. or more is preferable from the viewpoint of fine precipitation of a carbide when Nb or the like is added. The winding temperature 700° C. or less is preferable because a cementite precipitate does not become too coarse. If the winding temperature is in a temperature region of less than 450° C. or more than 700° C., the structure is likely to change during holding after winding in a coil, and rolling trouble etc. due to the non-uniformity of the metal structure of the material are likely to occur in cold rolling of a later step. From the viewpoints of grain size adjustment of the hot rolled sheet structure etc., the winding temperature is more preferably set to 500° C. or more and 680° C. or less.

Subsequently, cold rolling step is performed. Here, the hot-rolled steel sheet is usually made into a cold-rolled coil by performing cold rolling following pickling for the purpose of descaling. Such pickling is performed as needed.

It is preferable that cold rolling be performed with a rolling reduction ratio of 20% or more. This is for the purpose of forming a homogeneous and fine microstructure in the subsequent heating process. In the case where the rolling reduction ratio is less than 20%, since there may be a case where a microstructure having a large grain diameter or an inhomogeneous microstructure is formed when heating is performed, there is a risk of a deterioration in the strength and processability of a final product sheet after the subsequent heat treatment has been performed as described above. Although there is no particular limitation on the upper limit of the rolling reduction ratio, there may be a case of deterioration in productivity due to a high rolling load and deterioration in shape in the case where a high-strength steel sheet is subjected to cold rolling with a high rolling reduction ratio. It is preferable that rolling reduction ratio be 90% or less.

The above is a method for manufacturing a cold rolled material.

In the manufacturing method of the present invention, the cold rolled material may be heated in the temperature region of the Ac1 point to the Ac3 point+50° C., and may then be pickled. The heating and the pickling are not essential. However, in the case where heating is performed, it is necessary to perform pickling.

"Heating to a temperature region from the $A_{c1}$ point to the $A_{c3}$ point+50° C." is the condition for achieving high yield ratio and satisfactory plating ability in a final product. It is preferable that after performing this heating, a microstructure including ferrite and martensite be formed before the subsequent heat treatment process from the viewpoint of material properties. Moreover, it is also preferable that the oxides of, for example, Si and Mn be concentrated in the surface layer of a steel sheet through this heating process from the viewpoint of plating ability. From such points of view, heating is performed to a temperature region from the $A_{c1}$ point to the $A_{c3}$ point+50° C.

Here, $A_{c1}=751-27C+18Si-12Mn-23Cu-23Ni+24Cr+23Mo-40V-6Ti+32Zr+233Nb-169Al-895B$, and $A_{c3}=910-203\sqrt{C}+44.7\times Si-30Mn-11P+700S+400\times Al+400\times Ti$, where the atomic symbols in the equations above respectively denote the contents of the corresponding chemical elements, and where the symbol of a chemical element which is not contained is assigned a value of 0.

In the above pickling after heating, in order to achieve satisfactory plating ability by performing heating in a temperature region the $A_{c3}$ point or higher in the subsequent heat treatment process, the oxides of, for example, Si and Mn, which have been concentrated in the surface layer of the steel sheet, are removed by performing pickling.

In the annealing step, a cold rolled material having the component composition is heated in an annealing furnace atmosphere with a hydrogen concentration H of 1 vol % or more and 13 vol % or less, at an annealing furnace temperature T of (an $A_{c3}$ point −20° C.) to 900° C. or less for 5 sec or more, then cooled, and allowed the cold rolled material to stay in a temperature region of 400 to 550° C. for 10 sec or more.

The average heating rate for bringing the annealing furnace temperature T within the temperature region of (the $A_{c3}$ point −20° C.) to 900° C. or less is not particularly limited, but the average heating rate is preferably less than 10° C./s for the reason of the homogenization of the structure. Further, the average heating rate is preferably 1° C./s or more from the viewpoint of suppressing the reduction in manufacturing efficiency.

The heating temperature (annealing furnace temperature) T is set to (the $A_{c3}$ point −20° C.) to 900° C. in order to guarantee both material quality and plating ability. If the heating temperature is less than (the $A_{c3}$ point −20° C.), the finally obtained metal structure has a high ferrite fraction and consequently cannot obtain strength, and has limited production of bainite. In addition, it is not preferable that the heating temperature be higher than 900° C., because this results in deterioration in processability such as bendability and stretch flanging ability due to increased crystal grain diameter. In addition, in the case where the heating temperature is higher than 900° C., since Mn and Si tend to be concentrated in the surface layer, there is deterioration in plating ability. In addition, in the case where the heating temperature is higher than the $A_{c3}$ point and higher than 900° C., since a load placed on the equipment is stably high, there may be a case where manufacturing is not possible.

In the manufacturing method according to an embodiment of the present invention, heating is performed at the temperature of the annealing furnace temperature T of (the $A_3$ point −20° C.) to 900° C. for 5 sec or more. The heating time is preferably 180 sec or less for the reason of preventing the coarsening of surplus austenite grain diameters. The heating time is set to 5 sec or more from the viewpoint of the homogenization of the structure.

The hydrogen concentration H in the temperature region of (the $A_{c3}$ point −20° C.) to 900° C. is set to 1 to 13 vol %. In an embodiment of the present invention, not only the heating temperature described above but also the in-furnace atmosphere is simultaneously controlled; thereby, plating ability is guaranteed, and at the same time the entry of surplus hydrogen into the steel is prevented. If the hydrogen concentration is less than 1 vol %, non-plating often occurs. At hydrogen concentrations more than 13 vol %, the effect for plating ability is saturated, and at the same time the entry of hydrogen into the steel is considerably increased and various characteristics of the final product are degraded. Outside the temperature region of (the $A_{c3}$ point −20° C.) to 900° C. mentioned above, the hydrogen concentration may not be in the range of 1 vol % or more.

When performing cooling after staying in the hydrogen concentration atmosphere mentioned above, the workpiece is allowed to stay in the temperature region of 400 to 550° C. for 10 sec or more. This is in order to promote the production of bainite. As the prescription of the metal structure, bainite is an important structure to obtain high YS. To produce bainite and making the area ratio of bainite 10 to 50%, it is necessary to allow the workpiece to stay in this temperature region for 10 sec or more. Staying at less than 400° C. is not preferable because the temperature is likely to be below the plating bath temperature subsequently used and the quality of the plating bath is reduced. In this case, the sheet temperature may be raised up to the plating bath temperature by heating; thus, the lower limit of the temperature region mentioned above is set to 400° C. On the other hand, in the case where the retention temperature is higher than 550° C., ferrite and pearlite are more likely to be formed than bainite. It is preferable that a cooling be performed at a cooling rate (average cooling rate) of 3° C./s or more from the heating temperature to this temperature region. This is because, since ferrite transformation tends to occur in the case where the cooling rate is less than 3° C./s, there may be a case where to form the desired metal structure is not possible. There is no particular limitation on the upper limit of the preferable cooling rate. Although the cooling may be stopped in the above-described temperature region of 400° C. to 550° C., the steel sheet may be held in a temperature region of 400° C. to 550° C. after having been subjected to cooling to a temperature equal to or lower than the temperature region followed by reheating. In this case, there may be a case where martensite is formed and then tempered if cooling is performed to a temperature Ms point or lower In a plating step, plating treatment and alloying treatment are performed for a steel sheet after the annealing, and cooling up to 100° C. or less at an average cooling rate of 3° C./s or more is performed.

In the plating treatment and the alloying treatment, the attachment amount of plating per one surface is set to 20 to 120 g/m$^2$. Further, the content amount of Fe is 8 to 15% in mass %. As mentioned above, the galvanizing layer having a content amount of Fe in the range mentioned above is an alloyed hot-dip galvanizing layer. The galvanizing layer contains Al: 0.001% to 1.0%, as well as Fe. Further, as mentioned above, the galvanizing layer contains a prescribed amount of Mn oxides, and therefore contains Mn. The galvanizing layer may contain one or two or more selected from Pb, Sb, Si, Sn, Mg, Mn, Ni, Cr, Co, Ca, Cu, Li, Ti, Be, Bi, and the REMs at 0 to 30% in total. The balance is Zn and unavoidable impurities.

The method of plating treatment is preferably hot-dip galvanizing treatment. The conditions may be set as appropriate. Further, alloying treatment of performing heating after hot-dip galvanization is performed. Examples include a treatment of holding in the temperature region of 480 to 600° C. for approximately 1 to 60 seconds. By this treatment, an alloyed galvanizing layer having a content amount of Fe of 8 to 15% is obtained.

After the alloying treatment mentioned above, cooling is performed up to 100° C. or less at an average cooling rate of 3° C./s or more. This is in order to obtain martensite essential for strength increase. This is because cooling rates of less than 3° C./s make it difficult to obtain martensite necessary for strength, and stopping cooling at a temperature higher than 100° C. leads to a situation where martensite is excessively tempered (self-tempered) at this time point and austenite does not become martensite but transforms to ferrite, and necessary strength is difficult to obtain.

After the annealing step, a later heat treatment step is performed. The later heat treatment step is a step for allowing a plated steel sheet after the plating step to stay in an in-furnace atmosphere with a hydrogen concentration H of 10 vol % or less and a dew point Dp of 50° C. or leaa, at a temperature T (° C.) of 200° C. or less for a time t (hr) or more that is 0.01 (hr) or more and satisfies a (1) formula. (1) formula is as follows: $130-18.3\times\ln(t)\leq T$ (1).

The later heat treatment step is performed in order to obtain high yield strength and further in order to reduce the amount of diffusible hydrogen in the steel. The increase in the amount of diffusible hydrogen in the steel can be suppressed by creating an in-furnace atmosphere with a hydrogen concentration H of 10 vol % or less and a dew point Dp of 50° C. or less. The hydrogen concentration H is preferably smaller, and is preferably 5 vol % or less. The lower limit of the hydrogen concentration H is not particularly limited, and is preferably smaller as mentioned above; however, a preferred lower limit is 2 vol % or more because it is difficult to excessively reduce the hydrogen concentration. Even the air atmosphere has no problem. Further, to obtain the effects mentioned above, the dew point Dp is preferably 45° C. or less, and more preferably 40° C. or less. The lower limit of the dew point Dp is not particularly limited, but is preferably −80° C. or more from the viewpoint of manufacturing cost.

If the temperature for staying is a temperature more than 200° C., an excessive rise of yield strength is likely to occur; thus, the temperature mentioned above is set to 200° C. or less. The temperature is preferably 190° C. or less, and more preferably 180° C. or less. If the temperature for staying is less than room temperature, YR may not be enhanced. Further, if the temperature for staying is less than room temperature, it is difficult to sufficiently reduce the amount of diffusible hydrogen in the steel, and crevice cracking may occur in a weld. Thus, the lower limit of the temperature mentioned above is preferably 30° C. or more, and more preferably 50° C. or more.

To reduce the amount of hydrogen in the steel, it is important to make not only the temperature but also the time appropriate. By adjusting the time for staying such that it is 0.01 hr or more and satisfies the (1) formula, the amount of diffusible hydrogen in the steel can be reduced, and the yield strength can be adjusted such that the yield ratio is a moderate value of 65 to less than 85%.

Temper rolling is performed at an extension rate of 0.1% or more after the cooling of the plating step. Temper rolling may not be performed. Temper rolling is performed on the coated steel sheet with an extension rate of 0.1% or more for the purpose of stably achieving an YS in addition to correcting the shape and controlling the surface roughness. Processing through the use of leveler may be performed in addition to temper rolling for the purpose of correcting the shape and controlling the surface roughness. In the case where temper rolling is performed more than necessary, since excessive strain is applied to the surface of a steel sheet, there is a decrease in the evaluation values of ductility and stretch flanging ability. In addition, in the case where temper rolling is performed more than necessary, there is deterioration in ductility, and there is an increase in load placed on the equipment due to the high strength of the steel sheet. Therefore, it is preferable that temper rolling be performed with a rolling reduction ratio of 3% or less.

It is preferable to perform width trimming before or after the temper rolling mentioned above. Coil width adjustment can be performed by the width trimming. Further, by performing width trimming before the later heat treatment step as mentioned below, in-steel hydrogen can be released efficiently in the later heat treatment subsequently performed.

Width trimming is preferably performed before the later heat treatment step. In a case where width trimming is performed before the later heat treatment step, a staying time t (hr) for staying at a temperature T (° C.) of 200° C. or less in the later heat treatment step may be 0.01 (hr) or more and satisfy a (2) formula.

$$115-18.3\times ln(t)\leq T \quad (2)$$

As is clear from the (2) formula, as compared to the case of the (1) formula, the time can be shortened when the temperature condition is the same, and the temperature can be lowered when the condition of the staying time is the same.

EXAMPLE 1

Molten steel of the composition shown in Table 1 was smelted with a converter, and was fashioned into a slab by a continuous casting machine. The slab was heated to 1200° C., and was fashioned into a hot rolled coil by using a finish rolling temperature of 840° C. and a coil winding temperature of 560° C. The hot rolled coil was processed with a cold rolling reduction ratio of 50% into a cold rolled material with a sheet thickness of 1.4 mm. The cold rolled material was heated up to 810° C. (in the range of (the $A_{c3}$ point −20° C.) to 900° C.) by annealing treatment in an in-annealing-furnace atmosphere with a hydrogen concentration of 9 vol % and a dew point of −30° C., was allowed to stay for 15 seconds, was then cooled up to 500° C., and was allowed to stay for 30 seconds. After that, galvanization was performed and alloying treatment was performed; after the plating, the workpiece was passed through a water tank at a water temperature of 40° C. to be cooled up to 100° C. or less, with the average cooling rate set to 3° C./s; thus, a high-strength alloyed galvanized steel sheet (a product sheet) was manufactured. Here, the content amount of Fe and the attachment amount of the plating layer were adjusted so as to be in the ranges of the invention of the present application. After that, a later heat treatment was performed with various temperatures and times in an in-furnace atmosphere with a hydrogen concentration of 0 vol % and a dew point of −10° C. Temper rolling was performed after the plating, with the extension rate set to 0.2%. Width trimming was not performed.

Samples were cut out from each sheet, and were subjected to the analysis of hydrogen in the steel and the evaluation of nugget cracking of welds as the evaluation of hydrogen brittleness resistance. The results are shown in the figure.

Amount of Hydrogen in Steel

The amount of hydrogen in the steel was measured by the following method. First, an approximately 5×30-mm test piece was cut out from the alloyed galvanized steel sheet subjected to up to the later heat treatment. Next, a router was used to remove the plating on a surface of the test piece, and the test piece was put into a quartz tube. Next, the interior of the quartz tube was substituted with Ar, then the temperature was raised at 200° C./hr, and hydrogen generated until reaching 400° C. was measured with a gas chromatograph. In this way, the amount of hydrogen released was measured by the programed temperature analysis method. The cumulative value of the amount of hydrogen detected in the temperature region of room temperature (25° C.) to less than 210° C. was taken as the amount of diffusible hydrogen.

Hydrogen Brittleness Resistance

Nugget cracking of resistance spot welds of steel sheets was evaluated as the evaluation of hydrogen brittleness resistance. In the evaluation method, sheets each with a sheet thickness of 2 mm were placed as spacers individually between both ends of 30×100-mm sheets, and the centers between the spacers were joined together by spot welding; thus, a test piece was fabricated. At this time, for the spot welding, an inverter DC resistance spot welding machine was used, and a dome-form electrode made of chromium-copper and having a tip diameter of 6 mm was used as the electrode. The welding pressure was set to 380 kgf, the welding time to 16 cycles/50 Hz, and the holding time to 5 cycles/50 Hz. The welding current value was changed, and samples with various nugget diameters were produced.

The spacing between the spacers at both ends was set to 40 mm, and the steel sheets and the spacers were lashed by welding in advance. After the welding, the test piece was allowed to stand for 24 hours, then the spacer portions were cut off and the cross-sectional observation of the weld nuggets was performed to evaluate the presence or absence of cracking (crevices) due to hydrogen embrittlement, and the smallest nugget diameter out of the nugget diameters having no crevice was found. The figure shows a relationship between the amount of diffusible hydrogen and the smallest nugget diameter.

As shown in the figure, when the amount of diffusible hydrogen in the steel exceeds 0.20 mass ppm, the smallest nugget diameter increases rapidly, and the smallest nugget diameter exceeds 4 mm and degrades.

In the case where the amount of diffusible hydrogen is in the range of the present invention, the steel structure etc. are also in the ranges of the present invention.

TABLE 1

| Steel No. | C | Si | Mn | P | S | N | Al | Ti | Nb | B | Mo | Sb | Sn | Ca | AC1 (° C.) | AC3 (° C.) |
|---|---|---|---|---|---|---|---|---|---|---|---|---|---|---|---|---|
| | | | | | | | | | | | | | | | mass % | |
| B | 0.140 | 0.15 | 2.85 | 0.008 | 0.0008 | 0.0038 | 0.030 | 0.022 | 0.025 | 0.0015 | 0.00 | 0.0120 | 0.0050 | 0.0003 | 715 | 782 |

EXAMPLE 2

Various kinds of molten steel of the component compositions shown in Table 2 were smelted with a converter, and each was fashioned into a slab by a continuous casting machine; then, hot rolling, cold rolling, heating (annealing), pickling (in the case of "○" in Table 3, a pickling liquid in which the HCl concentration was adjusted to 5 mass % and the liquid temperature to 60° C. was used), heat treatment and plating treatment, temper rolling, coil width trimming, and a later heat treatment were performed under the various conditions shown in Table 3; thus, high-strength galvanized steel sheets (product sheets) each with a thickness of 1.4 mm were manufactured.

The cooling (cooling after plating treatment) was performed up to 50° C. or less by passing the workpiece through a water tank at a water temperature of 40° C.

TABLE 2

| Steel No. | C | Si | Mn | P | S | N | Al | Ti | Nb | V | Zr | B |
|---|---|---|---|---|---|---|---|---|---|---|---|---|
| A | 0.105 | 0.20 | 2.65 | 0.009 | 0.0010 | 0.0040 | 0.035 | | | 0.052 | 0.01 | |
| B | 0.140 | 0.15 | 2.85 | 0.008 | 0.0008 | 0.0038 | 0.030 | 0.022 | 0.025 | | | 0.0015 |
| C | 0.125 | 0.10 | 2.50 | 0.010 | 0.0009 | 0.0039 | 0.035 | 0.025 | 0.015 | | | |
| D | 0.185 | 0.02 | 2.22 | 0.010 | 0.0009 | 0.0055 | 0.035 | 0.025 | 0.020 | | | |
| E | 0.118 | 0.31 | 2.90 | 0.007 | 0.0015 | 0.0045 | 0.047 | | | | | |
| F | 0.080 | 0.60 | 2.05 | 0.001 | 0.0015 | 0.0040 | 0.035 | | 0.025 | | | 0.0010 |
| G | 0.160 | 0.10 | 1.85 | 0.010 | 0.0010 | 0.0040 | 0.030 | 0.018 | 0.023 | | | 0.0010 |
| H | 0.160 | 1.20 | 2.30 | 0.010 | 0.0009 | 0.0039 | 0.030 | 0.025 | 0.020 | | | |

mass %

| Steel No. | Mo | Cr | Cu | Ni | Sb | Sn | Ca | AC1 (° C.) | AC3 (° C.) | Note |
|---|---|---|---|---|---|---|---|---|---|---|
| A | | | 0.30 | 0.15 | | | 0.0001 | 702 | 794 | Example |
| B | 0.00 | | | | 0.0120 | 0.0050 | 0.0003 | 715 | 782 | Example |
| C | 0.10 | | | | | | | 719 | 799 | Example |
| D | 0.12 | | | | | | | 721 | 788 | Example |
| E | | | | | | | | 711 | 791 | Example |
| F | | | | | | | | 734 | 833 | Comparative Example |
| G | 0.10 | 0.1 | | | | | | 730 | 803 | Comparative Example |
| H | 0.12 | | | | | | | 743 | 842 | Comparative Example |

*Underline indicates values out of the range of the present invention.

By taking samples from the galvanized steel sheets obtained as described above, and by performing microstructure observation and a tensile test through the use of the methods described below, phase fraction (area ratio) of a metal structure, yield strength (YS), tensile strength (TS), and yield strength ratio (YR=YS/TS×100%) were determined or calculated.

Further, the external appearance was visually observed to evaluate plating ability (surface condition). The evaluation method is as follows.

Microstructure Observation

By taking a sample for microstructure observation from the hot-dip galvanized steel sheet, by polishing an L-cross section (thickness cross section parallel to the rolling direction), by etching the polished cross section through the use of a nital solution, by performing observation through the use of a SEM at a magnification of 1500 times in 3 or more fields of view in the vicinity of a position located ¼t (t denotes a whole thickness) from the surface in the etched cross section in order to obtain image data, and by performing image analysis on the obtained image data, area ratio was determined for each of the observed fields of view, and average value of the determined area ratios was calculated. However, the volume ratio of residual austenite (the volume ratio is regarded as the area ratio) was quantified by the intensity of X-ray diffraction. F of Table 4 stands for ferrite, M for martensite, M' for tempered martensite, B for bainite, and Residual γ for residual austenite.

Amount of Mn Oxides in Galvanizing Layer

The amount of Mn oxides in the galvanizing layer was measured by dissolving the plating layer in dilute hydrochloric acid in which an inhibitor was added and using the ICP emission spectroscopic analysis method.

Tensile Test

A tensile test was performed with a constant tensile speed (crosshead speed) of 10 mm/min on a JIS No. 5 tensile test piece (JIS Z 2201) taken from the galvanized steel sheet in a direction rectangular to the rolling direction.

The yield strength (YS) was defined as 0.2%-proof stress which was derived from the inclination in the elastic range corresponding to a strain of 150 MPa to 350 MPa, and the tensile strength was defined as the maximum load in the tensile test divided by the initial cross-sectional area of the parallel part of the test piece. When the cross-sectional area of the parallel part was calculated, the thickness was defined as the thickness including that of the coating layer.

Surface Quality (Appearance)

By performing, after a coating treatment, visual observation on the appearance after a heat treatment had been performed, a case where no bare spot was observed was judged as ○, a case where bare spots were observed was judged as ×, a case where no bare spot was observed but, for example, a variation in coating appearance was observed was judged as Δ. Here, the term "bare spots" denotes areas having a size of about several micrometers to several millimeters in which no coating layer exists so that the steel sheet is exposed.

Amount of Diffusible Hydrogen in Steel

The amount of diffusible hydrogen in the steel was measured by the following method. First, an approximately 5×30-mm test piece was cut out from the alloyed galvanized steel sheet subjected to up to the later heat treatment. Next, a router was used to remove the plating on a surface of the test piece, ultrasonic cleaning was performed with acetone, and then the test piece was put into a quartz tube. Next, the interior of the quartz tube was substituted with Ar, then the temperature was raised at 200° C./hr, and hydrogen generated until reaching 400° C. was measured with a gas chromatograph. In this way, the amount of hydrogen released was measured by the programed temperature analysis method. The cumulative value of the amount of hydrogen detected (released) in the temperature region of room temperature (25° C.) to less than 210° C. was taken as the amount of diffusible hydrogen in the steel.

Hydrogen Brittleness Resistance

Hydrogen embrittlement resistance characteristics of spot welds of steel sheets were evaluated as the evaluation of hydrogen brittleness resistance. In the evaluation method, sheets each with a sheet thickness of 2 mm were placed as spacers individually between both ends of 30×100-mm sheets, and the centers between the spacers were joined together by spot welding; thus, a test piece was fabricated. At this time, for the spot welding, an inverter DC resistance spot welding machine was used, and a dome-form electrode made of chromium-copper and having a tip diameter of 6 mm was used as the electrode. The welding pressure was set to 380 kgf, the welding time to 16 cycles/50 Hz, and the holding time to 5 cycles/50 Hz. As the welding current value, a condition whereby a nugget diameter according to the strength of each steel sheet was to be formed was used. A nugget diameter of 3.8 mm was employed for 1100 to 1250 MPa, a nugget diameter of 4.8 mm for 1250 to 1400 MPa, and a nugget diameter of 6 mm for 1400 MPa or more. The spacing between the spacers at both ends was set to 40 mm, and the steel sheets and the spacers were lashed by welding in advance. After the welding, the test piece was allowed to stand for 24 hours, then the spacer portions were cut off and the cross-sectional observation of the weld nugget was performed to evaluate crevice cracking due to hydrogen embrittlement. In the table, no crevice being present is shown by "○", and a crevice being present is shown by "×". The obtained results are collectively shown in Table 4.

TABLE 3

| | | Hot rolling | | | Cold rolling | Preceding process | | Annealing process | | | |
|---|---|---|---|---|---|---|---|---|---|---|---|
| No. | Steel No. | Slab heating temperature (° C.) | Finishing rolling temperature (° C.) | Coiling temperature (° C.) | Cold rolling reduction ratio (%) | Heating temperature (° C.) | Pickling done or undone | Average heating rate annealing process (° C./s) | Temperature T (° C.) | Heating time at temperature T (s) | Hydrogen concentration (vol. %) |
| 1 | A | 1280 | 920 | 520 | 60 | 750 | ○ | 5 | 810 | 100 | 13 |
| 2 | B | 1200 | 840 | 560 | 50 | 830 | ○ | 3 | 820 | 100 | 9 |
| 3 | B | 1200 | 840 | 560 | 50 | 830 | ○ | 3 | 720 | 100 | 9 |
| 4 | B | 1200 | 840 | 560 | 50 | 830 | ○ | 3 | 820 | 100 | 20 |
| 5 | B | 1200 | 840 | 560 | 50 | 830 | ○ | 3 | 820 | 100 | 9 |
| 6 | B | 1200 | 840 | 560 | 50 | 830 | ○ | 3 | 820 | 100 | 9 |
| 7 | B | 1200 | 840 | 560 | 50 | 830 | ○ | 3 | 820 | 100 | 9 |
| 8 | B | 1200 | 840 | 560 | 50 | 830 | Undone | 3 | 820 | 100 | 9 |
| 9 | B | 1200 | 840 | 560 | 50 | 830 | ○ | 3 | 820 | 100 | 9 |
| 10 | C | 1200 | 880 | 550 | 50 | 820 | ○ | 7 | 790 | 120 | 12 |
| 11 | D | 1230 | 900 | 600 | 40 | 820 | ○ | 4 | 790 | 30 | 12 |
| 12 | D | 1230 | 900 | 600 | 40 | 820 | ○ | 4 | 790 | 30 | 12 |
| 13 | D | 1230 | 900 | 600 | 40 | 820 | ○ | 4 | 790 | 30 | 12 |
| 14 | E | 1200 | 890 | 550 | 45 | None | Undone | 9 | 780 | 150 | 10 |
| 15 | F | 1250 | 860 | 550 | 30 | 820 | ○ | 3 | 830 | 100 | 10 |
| 16 | G | 1200 | 880 | 560 | 50 | 820 | ○ | 5 | 850 | 100 | 10 |
| 17 | H | 1220 | 890 | 560 | 50 | 820 | ○ | 5 | 860 | 100 | 10 |

| | Annealing process | | | | Later heat treatment | | | | |
|---|---|---|---|---|---|---|---|---|---|
| No. | Retention time*1 (s) | Average cooling rate after coating treatment*2 (° C./s) | Skin pass rolling Elongation ratio (%) | Width trimming | Hydrogen concentration (vol. %) | Dew-point (° C.) | Holding temperature (° C.) | Time (hr) | Note |
| 1 | 5 | 8 | 0.3 | — | 8 | 0 | 150 | 1 | Example |
| 2 | 30 | 5 | 0.2 | — | 3 | 0 | 100 | 6 | Example |
| 3 | 30 | 5 | 0.2 | — | 3 | 0 | 100 | 6 | Comparative Example |
| 4 | 30 | 5 | 0.2 | — | 3 | 0 | 100 | 6 | Comparative Example |
| 5 | 5 | 5 | 0.2 | — | 3 | 0 | 100 | 6 | Comparative Example |
| 6 | 30 | 1 | 0.2 | — | 3 | 0 | 100 | 6 | Comparative Example |
| 7 | 30 | 5 | 0.2 | After skin pass rolling | 3 | 0 | 100 | 3 | Example |
| 8 | 30 | 5 | 0.2 | — | 3 | 0 | 100 | 6 | Comparative Example |
| 9 | 30 | 5 | 0.2 | — | 3 | 0 | 100 | 1.5 | Comparative Example |
| 10 | 20 | 6 | 0.3 | — | 3 | 0 | 120 | 4 | Example |
| 11 | 20 | 4 | 0.25 | Before skin pass rolling | 3 | 0 | 180 | 0.5 | Example |
| 12 | 20 | 4 | 0.25 | Before skin pass rolling | 3 | 0 | 230 | 0.5 | Comparative Example |
| 13 | 20 | 4 | 0.25 | Before skin pass rolling | 20 | 0 | 180 | 0.5 | Comparative Example |

TABLE 3-continued

| | | | | | | | | | |
|---|---|---|---|---|---|---|---|---|---|
| 14 | 10 | 3 | 0.3 | — | 1 | −10 | 70 | 48 | Example |
| 15 | 10 | 5 | 0.1 | — | 3 | 0 | 150 | 2 | Comparative Example |
| 16 | 15 | 3 | 0.2 | — | 3 | 0 | 150 | 2 | Comparative Example |
| 17 | 15 | 5 | 0.3 | — | 3 | 0 | 100 | 6 | Comparative Example |

*Underline indicates values out of the range of the present invention.

*1This refers to a retention time in a temperature range of 400° C. to 550° C. before coating.

*2Average cooling rate after coating treatment: a temperature range is 450° C. to 100° C., in which a temperature of 100° C. is reached after the steel sheet has passed through the last cooling zone as a result of the steel sheet being passed through a water tank having a temperature of 40° C. so as to be cooled to a temperature of 50° C. or lower.

The steel sheets of Present Invention Examples obtained by using components and manufacturing conditions in the ranges of the present invention are each a steel sheet that has obtained a YS of 700 MPa or more and a YR of 85%>YR≥65% and has also prescribed plating quality and in which the amount of diffusible hydrogen in the steel is less than 0.20 mass ppm; thus, a steel sheet excellent also in hydrogen brittleness resistance has been obtained. The present invention in an embodiment is excellent particularly in terms of being adjustable up to a high range of less than 85% in accordance with uses.

TABLE 4

| | | Metal structure | | | | | Product sheet | | | | | | | | |
|---|---|---|---|---|---|---|---|---|---|---|---|---|---|---|---|
| | | | | M' | | Remainder | | | Coating | Mn | | | Amount of diffusible hydrogen | | |
| No. | Steel No. | F % | M % | in M % | B % | Y % | YS MPa | YR % | weight g/m2 | oxides g/m2 | Fe % | Surface quality | mass ppm | Weld cracking | Note |
| 1 | A | 13 | 50 | 80 | 35 | 2 | 715 | 68 | 60 | 0.040 | 10 | ○ | 0.14 | ○ | Example |
| 2 | B | 4 | 55 | 70 | 40 | 1 | 830 | 70 | 46 | 0.030 | 11 | ○ | 0.04 | ○ | Example |
| 3 | B | 40 | 40 | 70 | 20 | 0 | 680 | 63 | 46 | 0.030 | 11 | ○ | 0.04 | ○ | Comparative Example |
| 4 | B | 4 | 55 | 70 | 40 | 1 | 825 | 70 | 46 | 0.030 | 11 | ○ | 0.42 | X | Comparative Example |
| 5 | B | 5 | 90 | 65 | 5 | 0 | 690 | 62 | 46 | 0.030 | 11 | ○ | 0.25 | X | Comparative Example |
| 6 | B | 35 | 20 | 75 | 45 | 0 | 650 | 65 | 46 | 0.030 | 11 | ○ | 0.02 | ○ | Comparative Example |
| 7 | B | 4 | 55 | 70 | 40 | 1 | 825 | 70 | 46 | 0.030 | 11 | ○ | 0.07 | ○ | Example |
| 8 | B | 4 | 55 | 70 | 40 | 1 | 830 | 70 | 35 | 0.060 | 7 | X | 0.07 | ○ | Comparative Example |
| 9 | B | 4 | 55 | 35 | 40 | 1 | 790 | 67 | 46 | 0.030 | 11 | ○ | 0.37 | X | Comparative Example |
| 10 | C | 5 | 65 | 80 | 30 | 0 | 805 | 75 | 40 | 0.010 | 12 | ○ | 0.05 | ○ | Example |
| 11 | D | 3 | 70 | 50 | 25 | 2 | 980 | 83 | 42 | 0.020 | 10 | ○ | 0.02 | ○ | Example |
| 12 | D | 3 | 70 | 95 | 25 | 2 | 1050 | 89 | 42 | 0.020 | 10 | ○ | 0 | ○ | Comparative Example |
| 13 | D | 3 | 70 | 50 | 25 | 2 | 975 | 83 | 42 | 0.020 | 10 | ○ | 0.24 | X | Comparative Example |
| 14 | E | 15 | 60 | 60 | 25 | 0 | 750 | 65 | 45 | 0.035 | 9 | ○ | 0.03 | ○ | Example |
| 15 | F | 30 | 40 | 45 | 30 | 0 | 670 | 65 | 46 | 0.030 | 10 | X | 0.08 | ○ | Comparative Example |
| 16 | G | 5 | 45 | 80 | 45 | 2 | 660 | 66 | 50 | 0.010 | 12 | ○ | 0.05 | ○ | Comparative Example |
| 17 | H | 8 | 65 | 35 | 20 | 7 | 880 | 72 | 30 | 0.030 | 7 | X | 0.35 | X | Comparative Example |

*Underline indicates values out of the range of the present invention.

INDUSTRIAL APPLICABILITY

Since the hot-dip galvanized steel sheet according to embodiments of the present invention has not only a high tensile strength but also a high yield strength ratio and surface quality and hydrogen embrittlement resistance, the steel sheet contributes to environment conservation, for example, from the viewpoint of $CO_2$ emission by contributing to an improvement in safety performance and to a decrease in the weight of an automobile body through an improvement in strength and a decrease in thickness, in the case where the steel sheet is used for the skeleton parts, in particular, for the parts around a cabin, which has an influence on collision safety, of an automobile body. In addition, since the steel sheet has both good surface quality and coating quality, it is possible to actively use for parts such as chassis which are prone to corrosion due to rain or snow, and it is also possible to expect an improvement in the rust prevention capability and corrosion resistance of an automobile body. A material having such properties can effectively be used not only for automotive parts but also in the industrial fields of civil engineering, construction, and home electrical appliances.

The invention claimed is:

1. A high-strength galvanized steel sheet comprising:

a steel sheet having a steel composition having a component composition containing, in mass %, C: 0.10% or more and 0.30% or less, Si: less than 1.2%, Mn: 2.0% or more and 3.5% or less, P: 0.010% or less, S: 0.002% or less, Al: 1% or less, N: 0.006% or less, and the balance including Fe and unavoidable impurities, and the steel sheet having a steel structure containing 50% or more of martensite, 30% or less, including 0%, of ferrite, and 10 to 50% of bainite, and further containing less than 5%, including 0%, of residual austenite, in terms of area ratio, 30% or more of the martensite being tempered martensite, including self-tempered martensite, the steel sheet having an amount of diffusible hydrogen in the steel sheet being 0.20 mass ppm or less; and a galvanizing layer provided on a surface of the steel sheet, the galvanizing layer having a content amount of Fe of 8 to 15% in mass %, and an attachment amount of plating per one surface of 20 to 120 $g/m^2$, wherein an amount of Mn oxides contained in the galvanizing layer is 0.050 $g/m^2$or more, and the high-strength galvanized steel sheet has a yield strength of 700 MPa or more and a yield strength ratio of 65% or more and less than 85%.

2. The high-strength galvanized steel sheet according to claim 1, wherein the component composition further contains one or more Groups A to C, Group A: any one or more selected from, in mass %, one or more of Ti, Nb, V, and Zr: 0.005 to 0.1% in total, one or more of Mo, Cr, Cu, and Ni: 0.005 to 0.5% in total, and B: 0.0003 to 0.005%

Group B: any one or two selected from, in mass %, Sb: 0.001 to 0.1% and Sn: 0.001 to 0.1%

Group C: in mass %, Ca: 0.0010% or less.

3. A method for manufacturing a high-strength galvanized steel sheet according to claim 1 comprising:

an annealing step of heating a cold rolled material having the component composition according to claim 1 in an in-annealing-furnace atmosphere with a hydrogen concentration H of 1 vol % or more and 13 vol % or less, at an in-annealing-furnace temperature T of (an Ac3 point- 20° C.) to 900° C. or less for 5 sec or more, then performing cooling, and allowing the cold rolled material to stay in a temperature region of 400 to 550° C. for 10 sec or more;

a plating step of subjecting a steel sheet after the annealing step to plating treatment and alloying treatment, and performing cooling up to 100° C. or less at an average cooling rate of 3° C./s or more; and a later heat treatment step of allowing a plated steel sheet after the plating step to stay in an in-furnace atmosphere with a hydrogen concentration H of 10 vol % or less and a dew point Dp of 50° C. or less, at a temperature T in ° C. of 200° C. or less for a time tin hr or more that is 0.01 hr or more and satisfies a (1) formula:

$$130-18.3\times ln(t)\leq T \quad (1)$$

wherein $Ac3=910-203\sqrt{C}+44.7\times Si-30Mn-11P+700S+400\times Al+400\times Ti$, wherein the atomic symbols in the Ac3 equation denote the contents of the corresponding chemical elements in mass %, and the atomic symbol of the corresponding chemical element which is not contained is assigned a value of 0.

4. A method for manufacturing a high-strength galvanized steel sheet according to claim 2 comprising:

an annealing step of heating a cold rolled material having the component composition according to claim 2 in an in-annealing-furnace atmosphere with a hydrogen concentration H of 1 vol % or more and 13 vol % or less, at an in-annealing-furnace temperature T of (an Ac3 point- 20° C.) to 900° C. or less for 5 sec or more, then performing cooling, and allowing the cold rolled material to stay in a temperature region of 400 to 550° C. for 10 sec or more;

a plating step of subjecting a steel sheet after the annealing step to plating treatment and alloying treatment, and performing cooling up to 100° C. or less at an average cooling rate of 3° C./s or more; and a later heat treatment step of allowing a plated steel sheet after the plating step to stay in an in-furnace atmosphere with a hydrogen concentration H of 10 vol % or less and a dew point Dp of 50° C. or less, at a temperature T in ° C. of 200° C. or less for a time tin hr or more that is 0.01 hr or more and satisfies a (1) formula:

$$130-18.3\times ln(t)\leq T \quad (1)$$

wherein $Ac3=910-203\sqrt{C}+44.7\times Si-30Mn-11P+700S+400\times Al+400\times Ti$, wherein the atomic symbols in the Ac3 equation denote the contents of the corresponding chemical elements in mass %, and the atomic symbol of the chemical element which is not contained is assigned a value of 0.

5. The method for manufacturing a high-strength galvanized steel sheet according to claim 3, comprising, before the annealing step, an earlier treatment step of heating the cold rolled material up to an Ac1 point to the Ac3 point+50° C. and performing pickling, wherein $Ac1=751-27C+18Si-12Mn-23Cu-23Ni+24Cr+23Mo-40V-6Ti+32Zr+233Nb-169Al-895B$, wherein the atomic symbols in the Ac1 equation denote the contents of the corresponding chemical elements in mass %, and the atomic symbol of the chemical element which is not contained is assigned a value of 0.

6. The method for manufacturing a high-strength galvanized steel sheet according to claim 4, comprising, before the annealing step, an earlier treatment step of heating the cold rolled material up to an Ac1 point to the Ac3 point+50° C. and performing pickling, wherein $Ac1=751-27C+18Si-12Mn-23Cu-23Ni+24Cr+23Mo-40V-6Ti+32Zr+233Nb-169Al-895B$, wherein the atomic symbols in the Ac1 equation denote the contents of the corresponding chemical elements in mass %, and the atomic symbol of the chemical element which is not contained is assigned a value of 0.

7. The method for manufacturing a high-strength galvanized steel sheet according to claim 3, wherein, after the plating step, temper rolling is performed at an extension rate of 0.1% or more.

8. The method for manufacturing a high-strength galvanized steel sheet according to claim 4, wherein, after the plating step, temper rolling is performed at an extension rate of 0.1% or more.

9. The method for manufacturing a high-strength galvanized steel sheet according to claim 5, wherein, after the plating step, temper rolling is performed at an extension rate of 0.1% or more.

10. The method for manufacturing a high-strength galvanized steel sheet according to claim 6, wherein, after the plating step, temper rolling is performed at an extension rate of 0.1% or more.

11. The method for manufacturing a high-strength galvanized steel sheet according to claim 7, wherein width trimming is performed after the later heat treatment step.

12. The method for manufacturing a high-strength galvanized steel sheet according to claim 8, wherein width trimming is performed after the later heat treatment step.

13. The method for manufacturing a high-strength galvanized steel sheet according to claim 9, wherein width trimming is performed after the later heat treatment step.

14. The method for manufacturing a high-strength galvanized steel sheet according to claim 10, wherein width trimming is performed after the later heat treatment step.

15. The method for manufacturing a high-strength galvanized steel sheet according to claim 7, wherein width trimming is performed before the later heat treatment step, and a staying time t in hr for staying at a temperature T in ° C. of 200° C. or less in the later heat treatment step is 0.01 hr or more and satisfies a (2) formula:

$$115-18.3\times ln(t)\leq T \quad (2).$$

16. The method for manufacturing a high-strength galvanized steel sheet according to claim 8, wherein width trimming is performed before the later heat treatment step, and a staying time t in hr for staying at a temperature T in ° C. of 200° C. or less in the later heat treatment step is 0.01 hr or more and satisfies a (2) formula:

$$115-18.3\times ln(t)\leq T \quad (2).$$

17. The method for manufacturing a high-strength galvanized steel sheet according to claim 9, wherein width trimming is performed before the later heat treatment step, and a staying time t in hr for staying at a temperature T in ° C. of 200° C. or less in the later heat treatment step is 0.01 hr or more and satisfies a (2) formula:

$$115-18.3\times ln(t)\leq T \quad (2).$$

18. The method for manufacturing a high-strength galvanized steel sheet according to claim 10, wherein width trimming is performed before the later heat treatment step, and a staying time t in hr for staying at a temperature T in ° C. of 200° C. or less in the later heat treatment step is 0.01 hr or more and satisfies a (2) formula:

$$115-18.3\times ln(t)\leq T \quad (2).$$

* * * * *